US006285631B1

(12) United States Patent
Benjamin

(10) Patent No.: US 6,285,631 B1
(45) Date of Patent: Sep. 4, 2001

(54) SLOTTED CYLINDER TRANSDUCER WITH SEALING BOOT AND METHOD OF MAKING SAME

(75) Inventor: Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/412,194

(22) Filed: Oct. 4, 1999

(51) Int. Cl.[7] ..... H04R 17/00
(52) U.S. Cl. ..... 367/159
(58) Field of Search ..... 367/159, 173, 367/174; 310/337

(56) References Cited

U.S. PATENT DOCUMENTS 2,812,452 * 11/1957 Harris ..... 310/337
5,103,130 * 4/1992 Rolt et al. ..... 310/337
5,229,978 * 7/1993 Flanagan ..... 367/159
5,267,223 * 11/1993 Flanagan et al. ..... 367/159

* cited by examiner

*Primary Examiner*—Daniel T. Pihulic
(74) *Attorney, Agent, or Firm*—Michael J. McGowan; Prithvi C. Lall; Michael F. Oglo

(57) ABSTRACT

A sealed slotted cylinder includes an active transducer assembly, end caps at each end of the assembly, and a boot fused to the end caps and sealing the assembly. The sealed slotted cylinder is made using a dummy insert and a spacer within the dummy insert for spacing the end caps. A boot material made from an uncured rubber is wrapped around the dummy insert and the end caps. This assembly is placed in a mold that fuses the boot material to the end caps by vulcanizing the uncured rubber material. The mold and dummy insert preferably form longitudinal and circumferential boot roll seals on the boot material. A section of the boot is then removed forming an open region, allowing the dummy insert and spacer to be removed. The active transducer assembly can then be inserted through the open region such that the longitudinal boot roll seal engages and seals the slot in the active transducer assembly and the circumferential boot roll seals engage the end of the active transducer assembly.

18 Claims, 5 Drawing Sheets

SLOTTED CYLINDER TRANSDUCER WITH SEALING BOOT AND METHOD OF MAKING SAME

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to slotted cylinder transducers and in particular, to a reliable sealing boot for preventing external fluid from entering the slotted cylinder transducer and method of making the slotted cylinder transducer with reliable sealing boot.

(2) Description of the Prior Art

Slotted cylinder transducers have enjoyed notably high acoustic output and efficiency for their size and frequency of operation. These slotted cylinder transducers typically comprise an actuated slotted cylinder with end caps and a boot for sealing the slotted cylinder transducer. Prior art slotted cylinder transducers are found in U.S. Pat. No. 2,812,452 issued to W. T. Harris, U.S. Pat. No. 4,651,044 issued to H. W. Kompanek, U.S. Pat. No. 5,103,130 issued to K. D. Rolt, and U.S. Pat. Nos. 5,229,978 and 5,267,223 issued to Flanagan et al.

Prior art slotted cylinder transducers have suffered from poor reliability as a result of leaky boots. The leaking boots allow liquid to enter the transducer causing failure of the transducer. The leak conditions result from a marginally successful manual application of the boot to the slotted cylinder and end caps using an epoxy adhesive. The boot has historically been attached to relatively small bond areas where the boot is subject to high static and dynamic operating stresses causing failure of the seal formed by the boot. In addition, the manual application of the boot in combination with the epoxy adhesive can lead to the epoxy entering critical areas of the transducer affecting performance, e.g., variations in impedance near the mechanical resonance.

SUMMARY OF THE INVENTION

An object of the present invention is to produce a reliable seal of consistent quality by eliminating or substantially reducing the inconsistencies inherent in the prior manual application of boot seals to slotted cylinder transducers.

Another object of the present invention is to create reliable and efficient slotted cylinder transducers by preventing adhesive from interfering with the mechanical operation of the transducer in the critical areas of the transducer slot and interface between the cylindrical body and end caps.

A further object of the present invention is a booting process that can improve repeatability through automation.

The present invention features a sealed slotted cylinder transducer comprising an active transducer assembly, a pair of end caps and a boot. The end caps are spaced in relation to the cylinder body and the boot is fused to the end caps, e.g., by vulcanizing. The seal is then completed by adhering the boot to the cylinder of the transducer using conventional adhesives such as epoxy.

The present invention further comprises a method of forming a slotted cylinder transducer boot. The method comprises the step of attaching a pair of end caps to a dummy insert. A boot material is then wrapped around the dummy insert and end caps. The boot material is then fused to the end caps in a mold. In one example, the boot material is an uncured rubber material, which is fused to the end caps by vulcanizing. The assembly is then removed from the mold and a central region of the boot material is removed, allowing the end caps to be separated from the dummy insert. The dummy insert is removed and an active slotted cylinder is placed between the end caps. The boot material is then bonded to the active slotted cylinder in the region between the end caps and opposite the slot where the static and dynamic stresses are considerably less.

The present invention further includes a system for fusing a boot material to end caps of a slotted cylinder transducer. The system comprises a dummy insert, a spacer and a mold. The spacer is inserted into the dummy insert for spacing a pair of end caps in relation to the dummy insert. The dummy insert and end caps are wrapped with an boot material and inserted in the mold. The mold then fuses the boot material to the end caps.

Accordingly, the present invention encompasses the reliable boot seal of slotted cylinder transducers, the novel process for producing the sealed slotted cylinder transducer, and the unique system used in producing the sealed slotted cylinder transducer.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
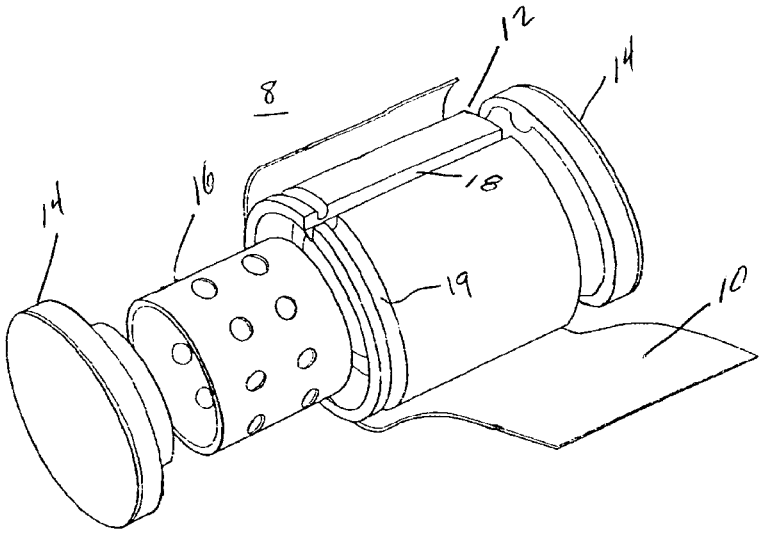
FIG. 1 is an exploded isometric view of the system for fusing a boot material to end caps of a sealed slotted cylinder transducer, according to the present invention.
Figure 2:
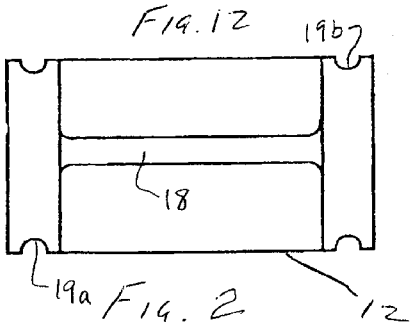
FIG. 2 is a schematic diagram of a dummy insert with attached end caps used in the boot molding process of the present invention.

The system of the present invention is used to fuse a boot material 10, FIG. 1, to end caps 14 of a slotted cylinder transducer. The system includes a dummy insert 12 and a spacer 16 inserted within the dummy insert 12. The dummy insert 12 is preferably a dummy ceramic/shell insert around which the boot material 10 is wrapped. A preferred embodiment of the dummy insert 12, FIG. 2, includes at least one longitudinal groove 18 and circumferential grooves 19*a*, 19*b*. The longitudinal groove 18 and circumferential grooves 19*a*, 19*b* facilitate the forming of circumferential and longitudinal boot seals, as will be described in greater detail below. The spacer 16 is preferably a center tube used to position the end caps 14 in relationship to the dummy insert 12.

Figure 3:
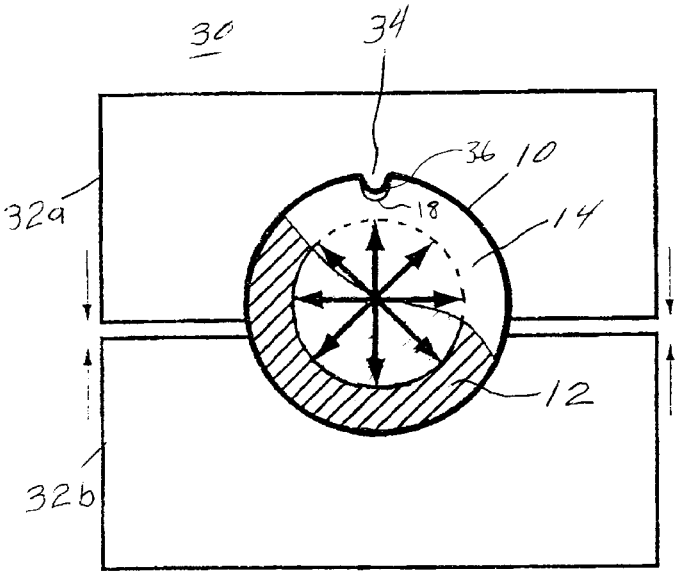
FIG. 3 is a schematic diagram of a mold used in the system and method of the present invention.
Figure 4:
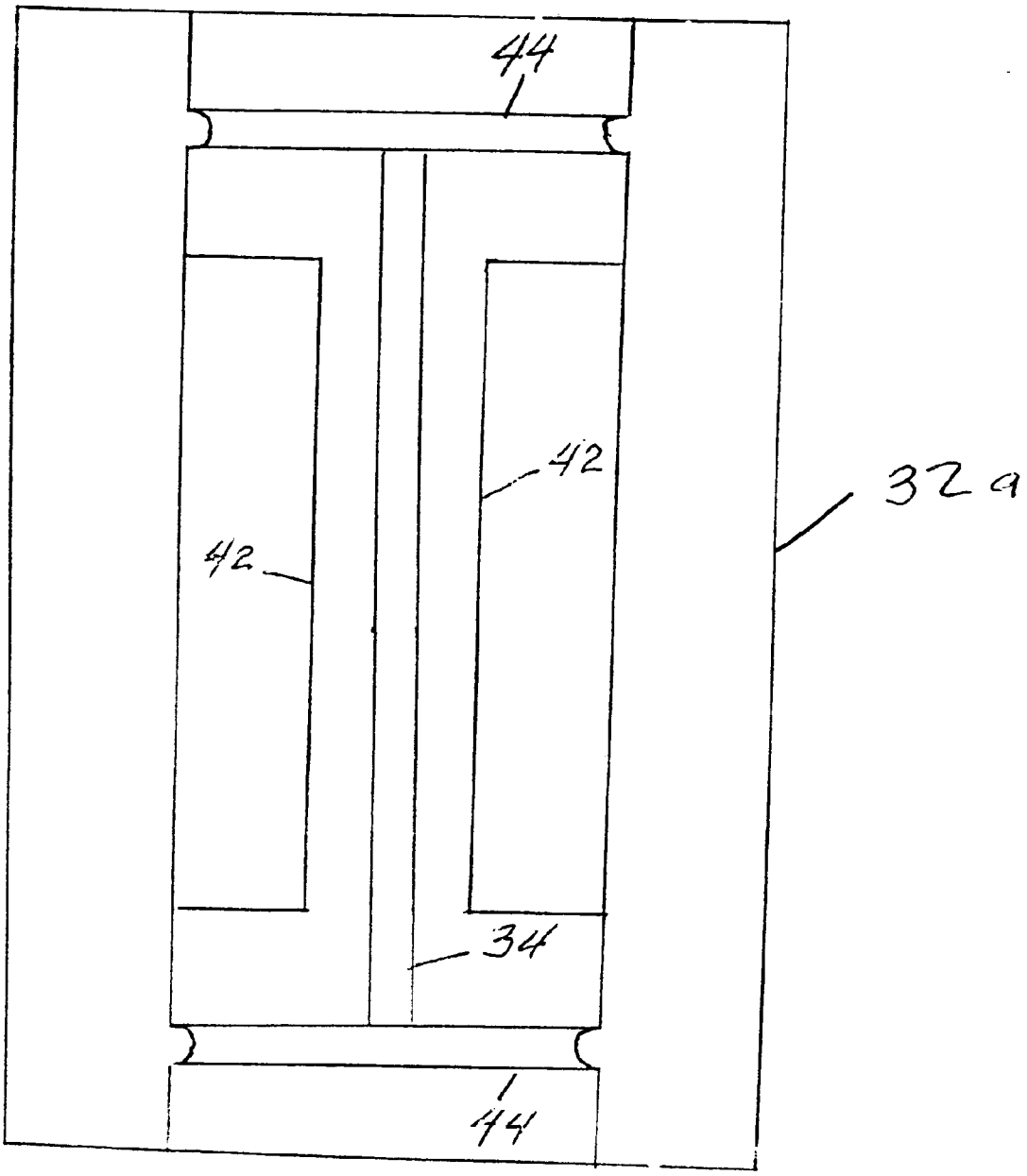
FIG. 4 is a top view of a first member of the mold showing internal ridges for forming the boot seal.
Figure 6:
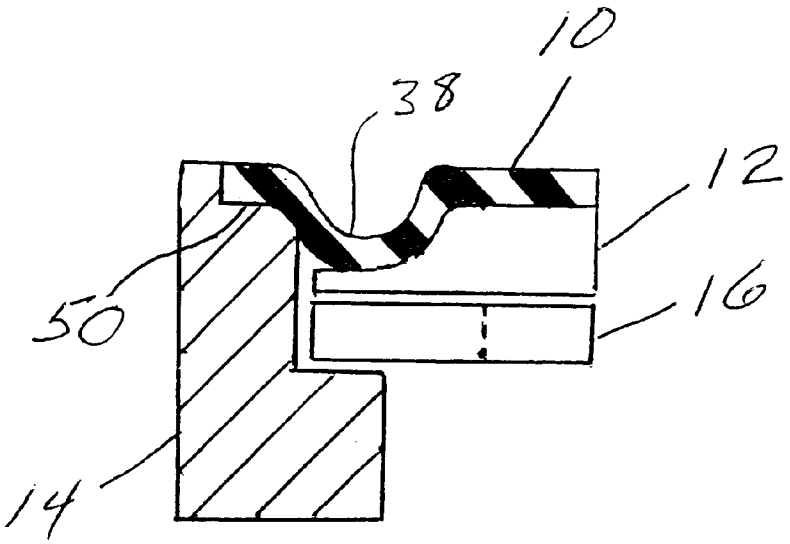
FIG. 6 is a partial cross-sectional view of the dummy insert, a spacer and the boot bonded to an end cap showing an optional groove, according to another embodiment of the present invention.
Figure 7:
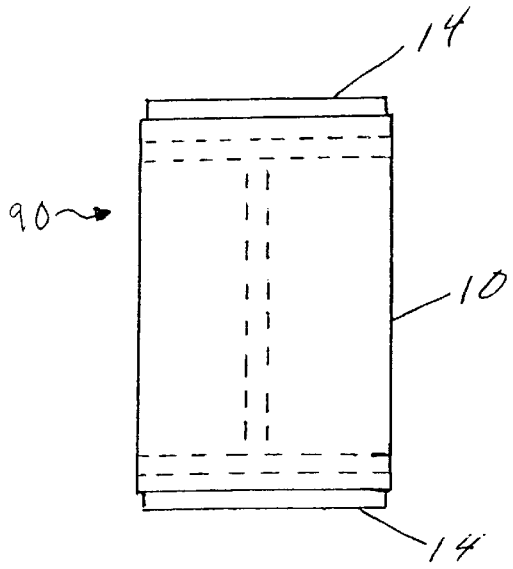
FIG. 7 is a side view of the boot formed around the dummy insert and bonded to the end caps.
Figure 8:
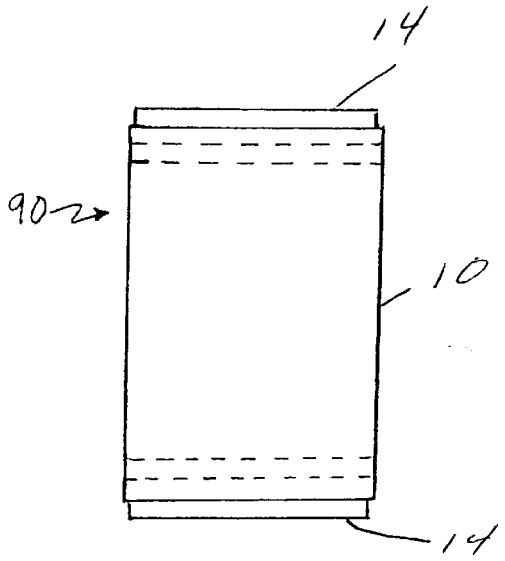
FIG. 8 is a side view of the opposite side of the boot shown in FIG. 7.
Figure 9:
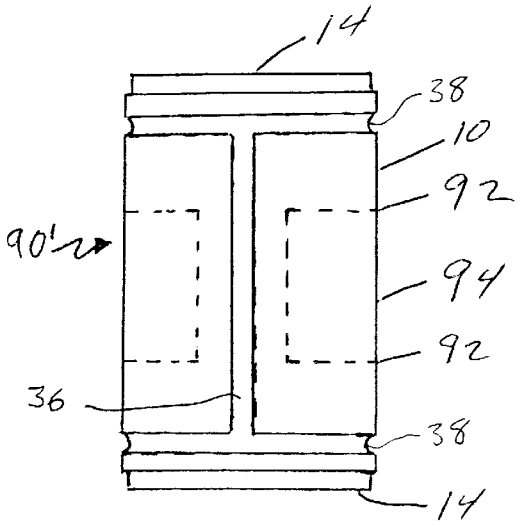
FIG. 9 is a side view of the boot formed around the dummy insert and bonded to the end caps with cut lines on the boot, according to one embodiment of the present invention.
Figure 10:
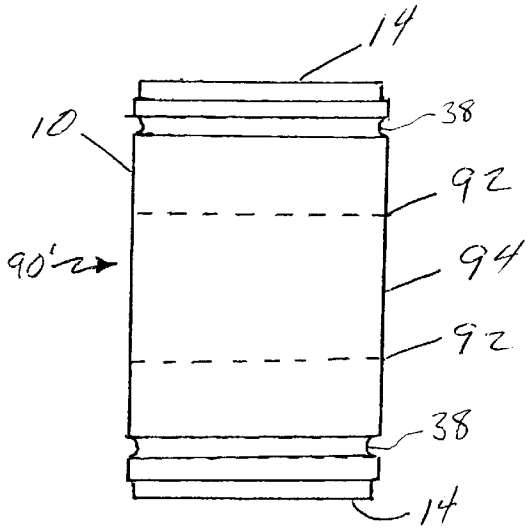
FIG. 10 is a side view of the opposite side of the boot shown in FIG. 9.

The system of the present invention further includes a mold 30, FIG. 3, for fusing the boot material 10 to the end caps. The mold 30 includes first and second mold members 32*a*, 32*b*. The boot material 10 is wrapped around the dummy insert 12 and end caps 14, and this assembly 8 is placed within first and second mold members 32*a*, 32*b* of mold 30. According to a preferred embodiment, one or both of the mold members 32*a*, 32*b*, FIG. 4, include a longitudinal ridge 34 corresponding to the longitudinal groove 18 of the dummy insert 12 and circumferential ridges 44 corresponding to the circumferential grooves 19*a*, 19*b* in the dummy insert 12. The longitudinal ridge 34 forms a longitudinal indentation or boot roll seal 36 in the boot material 10. The circumferential ridges 44 form a circumferential indentation or boot roll seal 38 (FIG. 6) in the boot material 10.

In one embodiment, at least one of the mold members 32*a*, 32*b* further includes an optional cut line forming element 42, for forming a cut line in the appropriate location on the boot 10 during the fusing process. This cut line may be perforated to facilitate the formation of element 42.

Figure 5:
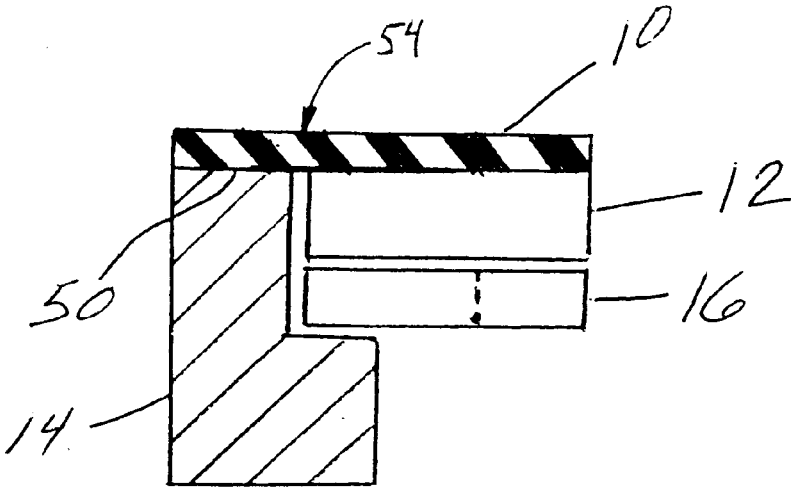
FIG. 5 is a partial cross-sectional view of the dummy insert, a spacer and the boot bonded to an end cap, according to one embodiment of the present invention.

According to the exemplary embodiment, the boot material 10 is formed from an uncured reinforced rubber material, such as Fairprene BN 5039-025. Prior to wrapping the uncured rubber material around the end caps 14, a rubber to metal primer, such as CHEMLOCK 217/220, is applied to a bonding surface area 50, FIGS. 5 and 6, of the end cap 14. The boot material 10 is then fused to the bonding surface area 50 of the end caps 14 by heat and pressure. The boot material 10 does not adhere to the dummy insert 12 since it has been mold released with Teflon™ or other equivalent materials known to the art.

According to one embodiment, the circumferential boot roll seal 38 (FIG. 6) is formed between the end cap 14 and dummy insert 12. The circumferential boot roll seal 38 is preferable for applications where greater flexibility is desired between the active transducer assembly and end caps 14. However, it is within the scope of the present invention to fuse the boot material 10 to end caps 14 with a substantially flat transition 54 (FIG. 5) between the dummy insert 12 and end caps 14.

After the boot material 10 is vulcanized and fused to the end caps 14 by mold 30, the fused assembly 90, 90', FIGS. 7–10, is removed from the mold members 32*a*, 32*b*. In the preferred embodiment, the fused assembly 90' (FIGS. 9 and 10) includes cut lines 92 imparted on the boot material 10 during the molding process, forming a patch or section 94 that can be removed with minimal effort. The section 94 is preferably in a non-critical area of the boot 10 running circumferentially around the boot stopping short of the longitudinal roll seal 36 and centered between the circumferential roll seals 38. Although the exemplary embodiment shows the patch or section 94 as rectangular in shape, other shapes are contemplated within the scope of the present invention. Alternatively, the assembly 90 (FIGS. 7 and 8) removed from the mold 30 might not include cut lines and boot roll seals.

Figure 11:
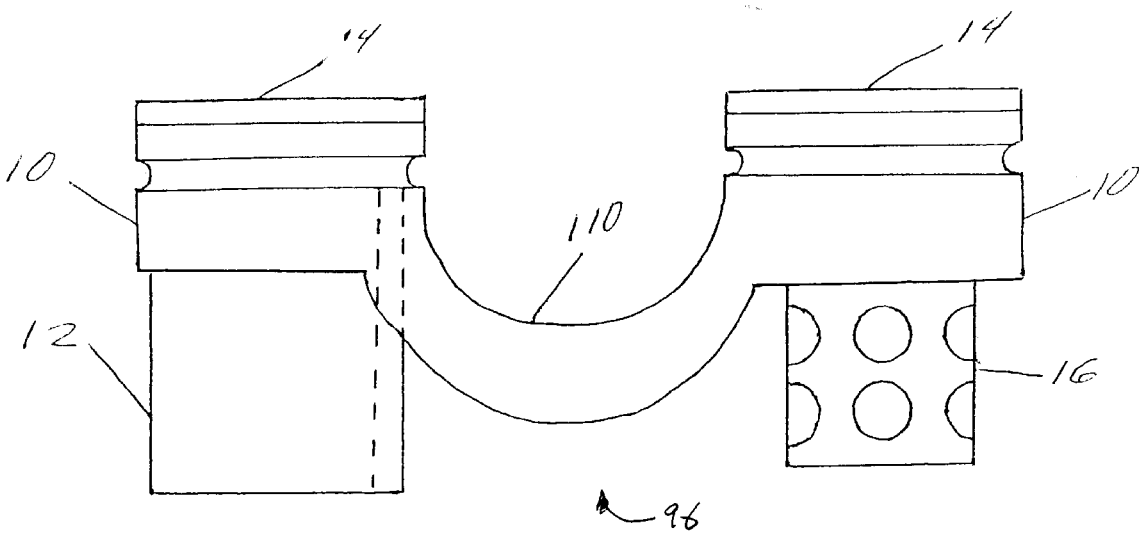
FIG. 11 is a side view showing the end caps separated from the dummy insert and spacer after removing a section from the boot material.

The removal of the section 94, FIG. 11, of the boot 10 provides an open region 96 that allows separation of the end caps 14 from the dummy insert 12 and optional spacer 16. The dummy insert 12 and spacer 16 can then be removed, leaving end caps 14 fused to the boot 10 and connected by a flap 110 of the boot 10 formed by removing the section 94 of the boot 10.

Figure 12:
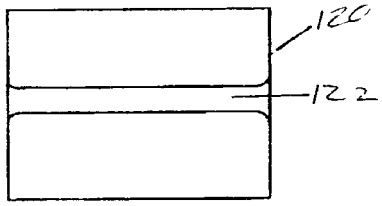
FIG. 12 is a schematic diagram of an active slotted cylinder of a slotted cylinder transducer.
Figure 13:
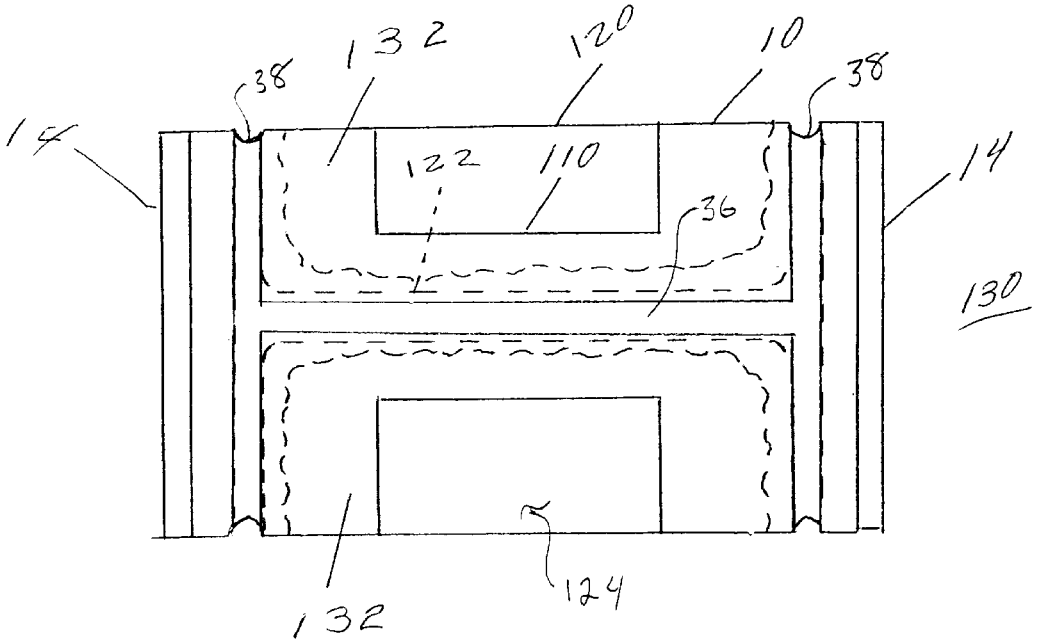
FIG. 13 is a side view of the completed sealed slotted cylinder transducer of the present invention.

An active transducer assembly 120, FIG. 12, is then inserted between the end caps 14 such that the flap 110 covers a slot 122, FIG. 13, in the active transducer assembly 120, leaving a central region 124 exposed. The active transducer assembly 120 comprises the functional portion of slotted cylinder transducers that can be of any type that is well known in the art of slotted cylinder transducers. To complete the sealed slotted cylinder transducer 130, the boot 10 is glued to the active transducer assembly 120 using epoxy or any other suitable adhesive in non-critical areas 132 of the active transducer assembly 120 forming a watertight seal between the end caps 14 and the slot 122 of the active transducer assembly 120. The non-critical area 132 is any place where the adhesive can be applied to the active transducer assembly 120 and the boot 10 without interfering with or contaminating the interface between the active transducer assembly 120 and end caps 14 or slot 122.

The sealed slotted cylinder transducer 130 thus includes the active transducer assembly 120, the end caps 14 at each end of the assembly 120, and the boot 10 sealing the assembly 120 and fused to the end caps 14. In the preferred embodiment, the t1 circumferential roll seals 38 engage the ends of the assembly 120 to provide greater flexibility between the active slotted cylinder and the end caps, thereby increasing the efficiency of the slotted cylinder transducer 130. The longitudinal roll seal 36 preferably engages the slot 122 in the active transducer assembly 120.

Accordingly, the sealed slotted cylinder transducer of the present invention solves the problem of leaky transducers by fusing the boot to the end caps. This fusion is formed in the most critical areas of sealed slotted cylinder transducers, which are most susceptible to failure resulting in leaking boot seals. A dummy insert is used in place of the active transducer assembly during the fusing process to prevent damage to the active transducer assembly. This process also repeatedly produces high quality sealed slotted cylinder transducers through an automated, mechanical molding process. This automated mechanical process also eliminates the prior problem of excess adhesive getting between the end caps and active slotted cylinder causing reduced efficiency.

In light of the above, it is therefore understood that within the scope of the appended claims, the invention may be practiced otherwise than as specifically described.

What is claimed is:

1. A sealed slotted cylinder transducer comprising:

an active transducer assembly having first and second ends and at least one slot extending between said first and second ends;

a pair of end caps disposed proximate said first and second ends; and a boot fused to said end caps and adhered to said active transducer assembly proximate said end caps and said at least one slot, wherein said boot covers said slot and covers gaps between said end caps and said active transducer assembly.

2. The sealed slotted cylinder transducer of claim 1 wherein said boot is formed from uncured reinforced rubber.

3. The sealed slotted cylinder transducer of claim 2 wherein said boot is fused to said end caps as a result of vulcanizing said uncured reinforced rubber.

4. The sealed slotted transducer of claim 1 wherein a central region of said outside surface of said active transducer assembly is exposed, said central region extending circumferentially from a location adjacent to one side of said slot to a location adjacent to a second side of said slot.

5. The sealed slotted transducer of claim 4 wherein said boot is formed from uncured reinforced rubber.

6. The sealed slotted cylinder transducer of claim 5 wherein said boot is fused to said end caps as a result of vulcanizing said uncured reinforced rubber.

7. The sealed slotted cylinder transducer of claim 1 wherein said boot includes a longitudinal boot roll seal engaged with said slot of said active transducer assembly.

8. The sealed slotted cylinder transducer of claim 1 wherein said boot includes circumferential boot roll seals engaged with said first and second ends of said active transducer assembly.

9. A method of forming a slotted cylinder transducer, said method comprising the steps of:

attaching a pair of end caps proximate each end of a dummy insert;

wrapping a boot material around said dummy insert and said pair of end caps;

fusing said boot material to said end caps;

removing a section of said boot material to form an open region in said boot material;

removing said dummy insert from said end caps and through said open region in said boot material;

placing an active transducer assembly between said end caps; and adhering said boot material to said active transducer assembly adjacent said end caps and to a location adjacent to each side of at least one slot in said active transducer assembly.

10. The method of forming a slotted cylinder transducer of claim 9 further comprising the step of inserting a spacer within said dummy insert, for positioning said end caps.

11. The method of forming a slotted cylinder transducer of claim 9 further comprising the step of placing cut lines on said boot material to facilitate removing said section of said boot material.

12. The method of forming a slotted cylinder transducer of claim 9 wherein the step of adhering includes bonding said boot material to said active slotted cylinder with an adhesive.

13. The method of forming a slotted cylinder transducer of claim 9 wherein said boot material is formed from uncured reinforced rubber, and wherein the step of fusing further comprises the steps of:

applying a bonding primer to said pair of end caps; and vulcanizing said uncured reinforced rubber to said pair of end caps through a combination of heat and pressure.

14. A system for fusing a boot material to end caps of a slotted cylinder transducer, the system comprising:

a dummy insert possessing a mold release surface of polytetrafluoroethylene;

a spacer for being received within said dummy insert for spacing said end caps in relation to said dummy insert, wherein said boot material is wrapped around said dummy insert and said end caps forming an assembly; and a mold having first and second mold members for receiving said assembly, wherein said mold fuses said boot material to said end caps.

15. The system of claim 14 wherein one of said first and second mold members includes at least one longitudinal ridge disposed longitudinally on an interior region, and wherein said dummy insert includes a longitudinal groove corresponding to said longitudinal ridge for forming a longitudinal indentation in said boot material.

16. The system of claim 14 wherein each of said first and second mold members includes circumferential ridges disposed longitudinally on an interior region proximate each end of said first and second mold members, and wherein said dummy insert includes circumferential grooves corresponding to said circumferential ridges for forming circumferential indentations in said boot material proximate each end.

17. The system of claim 11 wherein said first and second mold members include a means for forming a cut line in said boot material defining a section to be removed.

18. A sealed slotted cylinder transducer comprising:

an active transducer assembly having first and second ends and at least one slot extending between said first and second ends;

a pair of end caps disposed proximate said first and second ends; and a boot fused to said end caps and adhered to said active transducer assembly proximate said end caps and said at least one slot, wherein said boot includes circumferential boot roll seals engaged with said first and second ends of said active transducer assembly.

* * * * *